US005405047A

United States Patent [19]

Hansen

[11] Patent Number: 5,405,047

[45] Date of Patent: Apr. 11, 1995

[54] DISPENSER FOR PILLS OR TABLETS

[75] Inventor: Ib Hansen, Herlev, Denmark

[73] Assignee: Novo Nordisk A/S, Bagsvaerd, Denmark

[21] Appl. No.: 244,570

[22] PCT Filed: Nov. 19, 1992

[86] PCT No.: PCT/DK92/00343

§ 371 Date: Jun. 1, 1994

§ 102(e) Date: Jun. 1, 1994

[87] PCT Pub. No.: WO93/11056

PCT Pub. Date: Jun. 10, 1993

[30] Foreign Application Priority Data

Dec. 5, 1991 [DK] Denmark ..... 1962/91

[51] Int. Cl.[6] ..... B65G 59/00

[52] U.S. Cl. ..... 221/190; 221/289

[58] Field of Search ..... 221/190, 186, 289, 298, 221/294

[56] References Cited

U.S. PATENT DOCUMENTS

| | | | |
|---|---|---|---|
| 4,230,236 | 10/1980 | Boulter | 221/190 |
| 4,354,619 | 10/1982 | Wippermann et al. | 221/289 |
| 4,418,838 | 12/1983 | Gallina | 221/289 |
| 4,653,668 | 3/1987 | Gibilisco | 221/298 |
| 4,767,023 | 8/1988 | Hackmann et al. | 221/190 |
| 4,854,478 | 8/1989 | Gyimothy | 221/190 |

FOREIGN PATENT DOCUMENTS

| | | | |
|---|---|---|---|
| 0188278 | 7/1986 | European Pat. Off. | 221/190 |
| 0408774 | 6/1991 | European Pat. Off. | 221/186 |
| 3741960 | 12/1087 | Germany . | |
| 2925432 | 1/1981 | Germany | 221/289 |
| 3018041 | 11/1981 | Germany . | |
| 336551 | 2/1936 | Italy | 221/190 |

*Primary Examiner*—H. Grant Skaggs
*Attorney, Agent, or Firm*—Steve T. Zelson

[57] ABSTRACT

A dispenser for dispensing tablets one at a time from an unarranged stock of tablets in the dispenser. The dispenser comprises a first reservoir part axially displaceable in a second reservoir part against the force of a spring (4). A trough shaped part (5,6) at the inner end of the first part forms with a partition (13) at the bottom of the second part a downward closed channel accommodating at least two tablets when the dispenser is in its neutral position. When the dispenser is operated by forcing the first part further into the second part, a bottom (7) closing the channel is passed free of the partition (13) and the lowermost tablet is dispensed. At the same time two fingers (9) are passed into the space left at the sides of the channel between the lowermost tablet and the adjacent tablet above it to ensure that only the lowermost tablet is dispensed.

9 Claims, 3 Drawing Sheets

DISPENSER FOR PILLS OR TABLETS

Figure 1:
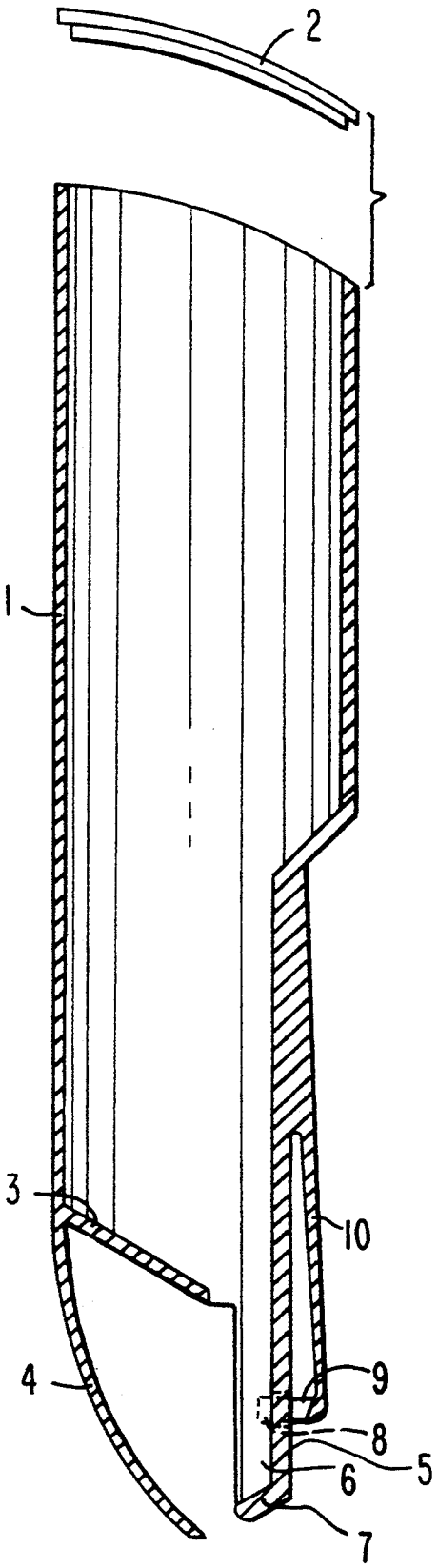

The invention relates to dispensers for pills or tablets in which dispenser pills or tablets are stored among each other in a non-ordered way, and from which they are dispensed one at a time when the dispenser is operated.

Such dispensers are well known and are usually based on a member having the shape of a drawer without a bottom, which drawer in its neutral position is upwards open but closed downwards by sliding along a wall. In this position the drawer accommodates just one pill or tablet. When the dispenser is operated, the drawer is passed with its upper opening under a separating wall to separate the drawer space from the reservoir, whereupon the drawer is passed over an opening in the bottom wall to dispense the pill or the tablet accomodated in the drawer through this opening.

The separation of the pill or tablet in the drawer is obtained by mechanically affecting the pill or tablet which is on its way into the drawer, but is stopped due to the fact that the drawer accommodates only one pill or tablet. The shearing affection provided by the separating wall may damage the edge of a tablet or make facets on a pill. When a pill or tablet damaged this way falls into the drawer, the next pill or tablet will reach a little further into the drawer, and the risk exists that this pill or tablet is directly crushed when the separating wall tries to shear it away from the drawer.

It is, therefore, the object of the invention to provide a dispenser in which one pill or tablet at a time is separated from a batch of tablets stored in a reservoir, without the above risk of crushing.

This is obtained by a dispenser of the kind mentioned in the beginning of this application, which dispenser is characterized in, that it comprises a first reservoir part forming at its one end a depending trough shaped to accommodate at least two tablets or pills adjacent to each other; a second reservoir part into which the first part fits with its trough end first, and having at its end a partition forming with the trough of the first part a channel for the accommodation of at least two pills or tablets adjacent to each other, the lower end of the channel being closed by an end wall carried by the first part and adjoining the lower end of the partition when the first part is in a neutral position in the second part; two fingers suspended at the outside of the first part and protruding into openings in the bottom of the trough perpendicular to this bottom and adjacent to the sides of the trough and positioned in the common tangent plane of two neighbouring pills or tablets in the channel; means being provided to pass the fingers through the openings into the free space between two pills or tablets in the channel when the first part from its neutral position is telescoped further into the second part.

In the dispenser according to the invention no shearing affection is exerted on the pills or tablets, and the risk of crushing the pills or tablets is consequently eliminated. The fingers pass into the space left between the pills due to their circular shape, and the pill or tablet adjacent to the one being dispensed is held back by being obstructed by the fingers which do not affect the tablets or pills mechanically.

The fingers may be provided at an end of a resilient beam secured to the outer surface of the first part, and a ramp may be provided at the inside of the second part to affect the fingers or their suspension to pass the fingers which are in the neutral position of the first part relative to the second part flush with the bottom of the trough, into the space left between two neighbouring pills or tablets when the first part is passed further into the second part.

To guide the pills or tablets to the dispensing channel the first part has a bottom wall inclining .downwards towards the upper end of the partition.

A spring may be provided to urge the first part towards its neutral position, and the first part inclusive the spring and the beam with the fingers may be moulded as one integral part.

When the dispenser according to the invention is operated, the partition will shoot into the room of the reservoir immediately above the dispensing channel, where the pills or tablets notoriously tend to bridge instead of falling down to be dispensed. As another feature counteracting such bridging the dispenser may be so designed that it cannot be left standing. This way it is ensured that the dispenser is turned over each time it has been used.

Figure 2:
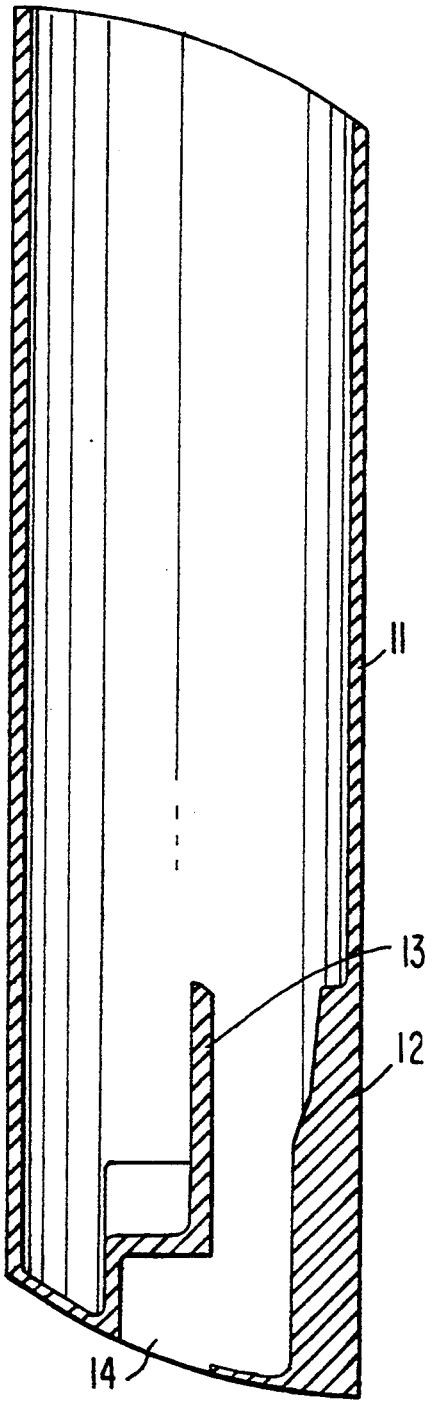
Figure 3:
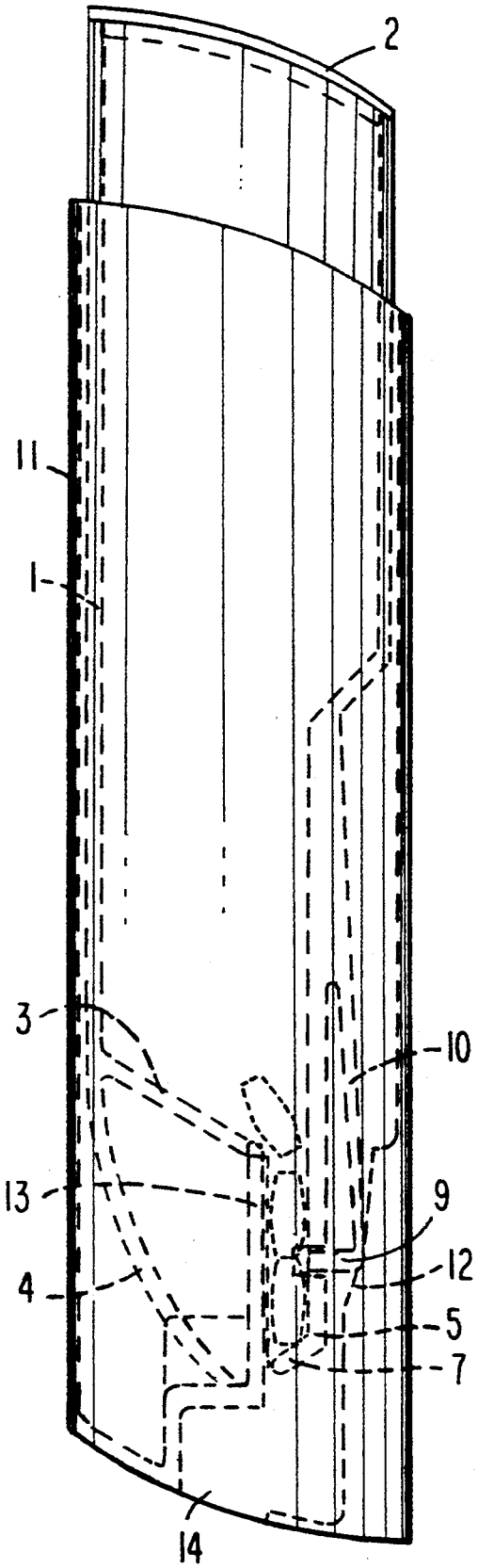
Figure 4:
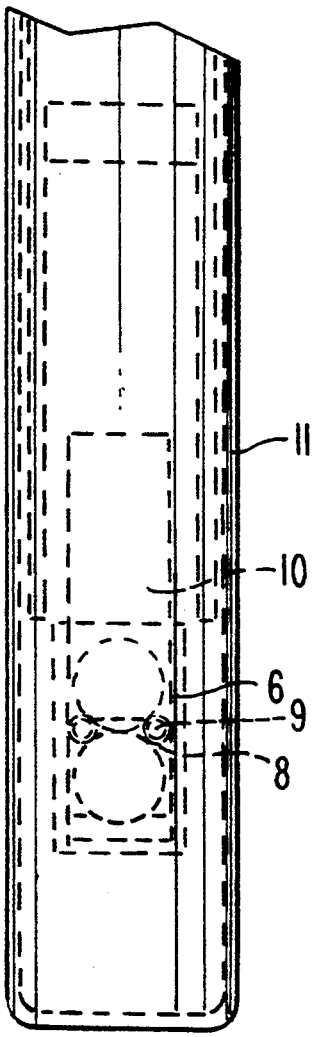
Figure 5:
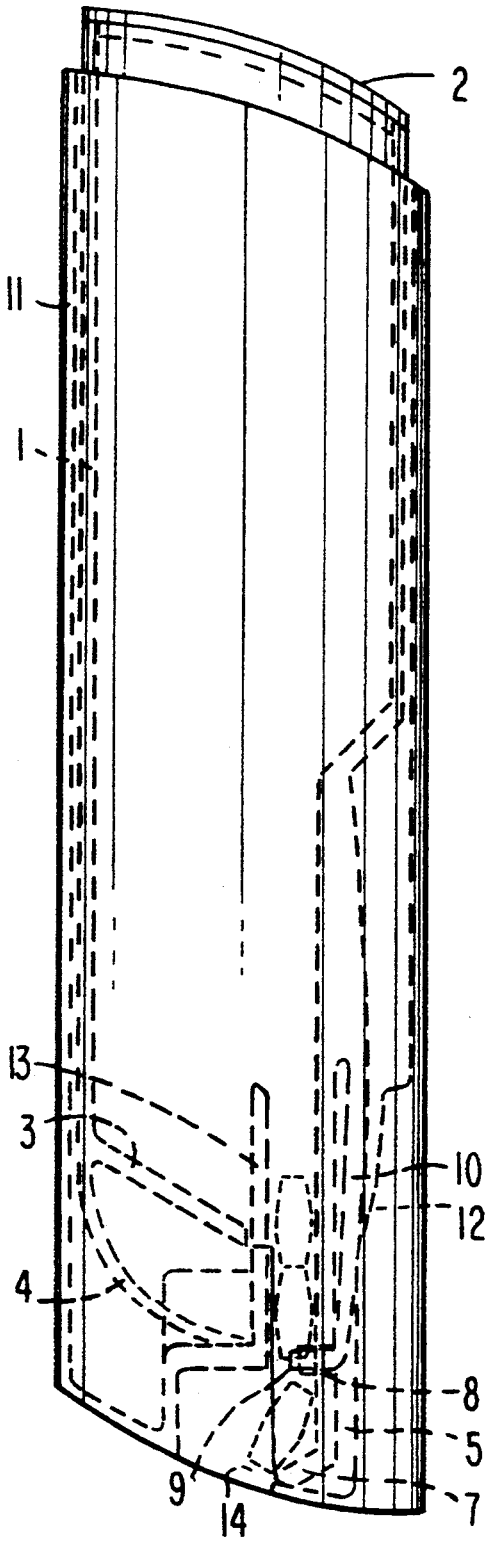
Figure 6:
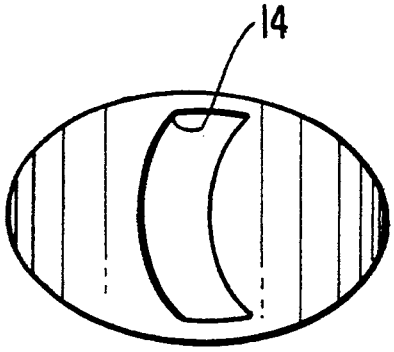

In the following the invention will be described with references to the drawings, wherein FIG. 1 shows a sectional view of the inner part of a dispenser according to the invention, FIG. 2 shows a sectional view of the outer part of a dispenser according to the invention, FIG. 3 shows a dispenser assembled from the parts of FIGS. 1 and 2 and shown in its neutral position, FIG. 4 shows the lower part of the dispenser of FIG. 3 seen from its right side, FIG. 5 shows the dispenser of FIG. 3 in its operated position, FIG. 6 shows the dispenser of FIG. 3 seen from its lower end.

The inner part of a dispenser as shown in FIG. 1 has side walls 1 forming a reservoir into which pills or tablets to be dispensed may be filled. After the filling, the reservoir is closed by a lid 2 which is glued or welded to the upper edge of the walls 1. The reservoir is not filled until it is mounted in a lower part.

At its lower end the inner part has an inclined wall 3 and a spring 4 moulded integrally with the reservoir. Further, the bottom of the inner part is shaped as a depending trough having a bottom 5, side walls 6 and an end wall 7.

Openings 8 are provided through the bottom 5 of the trough, which bottom 5 is arcuated to be suited to the shape of the pills or tablets to be guided.

Fingers 9 protrude into the openings 8 so that the inner end of these fingers are lowered in relation to the inner surface of the bottom 5 of the trough, or are flush with this surface. The fingers are suspended by a flexible beam 10 which is formed as an integral part of the inner part of the dispenser.

FIG. 2 shows the outer part of a dispenser according to the invention, this outer part comprising a side wall 11 forming a tube having a cross-section and dimensions corresponding to the outer dimension of the inner parts, which consequently fit into this outer part. At the lower end of the wall 11 a ramp shaped part 12 is provided, and a partition 13 extends from the bottom of the lower part into the inner space of this part. Further, the bottom has an opening 14 between the partition 13 and the ramp shaped part 12.

In FIG. 3, the inner part is mounted in the outer part to form the dispenser in its neutral position. This Figure further illustrates how tablets may be guided along the inclined wall over the upper edge of the partition 13 into a channel defined by this partition 13 and the trough. The end wall 7 of the trough, which end wall adjoins the lower part of the partition 13, prevents the tablets in the channel from falling out, and consequently the tablets are ordered in a short row in the channel with two tablets adjacent to each other.

When a tablet is to be dispensed, the dispenser is operated by pressing the inner part further into the outer part. This is done against the force of the spring 4 which will press the inner part back to its neutral position when the press is released.

When the inner part is passed further into the outer part, the suspension 10 of the fingers 9 will engage the ramp shaped part 12 of the outer part, and the fingers 9 will be forced through the openings 8 until their free ends are close to the partition 13. Thereby the fingers will pass into the space left free between two neighbouring tablets due to their circular shape. The tablet adjacent to the end wall 7 of the trough will then be passed downwards accomodated in the space between this end wall 7 and the fingers 7 until the lower edge of the partition 13 is passed and the tablet falls out through the opening 14 in the bottom of the second part of the dispenser. The tablet above the fingers 9 follows the fingers on their way upwards when the inner part returns to its neutral position. When the suspension 10 gets out of engagement with the ramp shaped part 12, the fingers are retracted from the channel, and the tablet resting on the fingers may drop down into the lower end of the trough.

FIG. 5 shows the inner part in its fully depressed position. As it is seen, the partition 13 here projects into the inner room of the dispenser to break a possible bridge formed by jamming tablets.

I claim:

1. A dispenser for pills or tablets stored in a non-ordered way in the dispenser from which they are dispensed one at a time, which dispenser comprises a first reservoir part having at its one end a depending trough shaped to accommodate at least two tablets or pills adjacent to each other, a second reservoir part into which the first part fits telescopically displaceable between a neutral and a dispensing position and with its trough end first, the second part having at its end a partition forming with the trough of the first part a channel for the accommodation of at least two pills or tablets adjacent to each other, the lower end of the channel being closed by an end wall carried by the first part and adjoining the lower end of the partition when the first part is in a neutral position in the second part, characterized in that two fingers are suspended at the outside of the first part and protrudes into openings in the bottom of the trough perpendicular to this bottom and adjacent to the sides of the trough and positioned in the common tangent plane of two neighbouring pills or tablets in the channel, and that means are provided to pass the fingers through the openings into the free space between two pills or tablets in the channel when the first part from its neutral position is telescoped further into the second part.

2. A dispenser according to claim 1, characterized in, that the fingers are provided at an end of a resilient beam secured to the outer surface of the first part, and that a ramp is provided at the inside of the second part to affect the fingers or their suspension to pass the fingers, which are in the neutral position of the first part relative to the second part flush with the bottom of the trough, into the space left between two neighbouring pills or tablets when the first part is passed further into the second part.

3. A dispenser according to claim 2, characterized in that the first part has a bottom wall inclining downwards towards and adjoining the upper end of the partition.

4. A dispenser according to claim 2, characterized in that a spring is provided urging the second part towards its neutral position.

5. A dispenser according to claim 1, characterized in that the first part has a bottom wall inclining downwards towards and adjoining the upper end of the partition.

6. A dispenser according to claim 5, characterized in, that the first part inclusive the spring and the beam with the fingers is moulded as one integral part.

7. A dispenser according to claim 3, characterized in that a spring is provided urging the second part towards its neutral position.

8. A dispenser according to claim 1, characterized in, that a spring is provided urging the second part towards its neutral position.

9. A dispenser according to claim 1, characterized in, that it is so designed that it cannot be left standing up.

* * * * *